US005139216A

United States Patent [19]

Larkin

[11] Patent Number: 5,139,216

[45] Date of Patent: Aug. 18, 1992

[54] SEGMENTED PROJECTILE WITH DE-SPUN JOINT

[76] Inventor: William Larkin, 15181 Woodlawn Ave., Tustin, Calif. 92680

[21] Appl. No.: 697,629

[22] Filed: May 9, 1991

[51] Int. Cl.[5] ..... F42B 10/26; F42B 10/60

[52] U.S. Cl. ..... 244/3.21; 244/3.23; 244/3.1

[58] Field of Search ..... 244/3.1, 3.3, 3.23, 244/3.21

[56] References Cited

U.S. PATENT DOCUMENTS

| | | | |
|---|---|---|---|
| 2,594,766 | 4/1952 | Goddard | 244/3.1 |
| 3,262,655 | 7/1966 | Gillespie | 244/3.1 |
| 4,399,962 | 8/1983 | Wedertz et al. | 244/3.23 |
| 4,431,147 | 2/1984 | Paley | 244/3.1 |
| 4,579,298 | 4/1986 | Thomson | 244/3.1 |
| 4,793,571 | 12/1988 | Kranz | 244/3.1 |

OTHER PUBLICATIONS

*J. Guidance and Control:* Sep./Oct. 1979-vol. 2, No. 5; pp. 382-387; "Larkin and Thomas; Atmospheric Flight of a Variable-Bend Body".

*Primary Examiner*—Michael J. Carone

[57] ABSTRACT

A projectile which would ordinarily be a spinning artillery shell is segmented so that the forward segment can be deflected relative to the rear segment for aerodynamic directional corrections in flight. Fins provide the projectile spin and a motor in the rear segment rotates an angle drive means with a velocity equal and opposite to the rotation of the rear segment, so that the angle drive means can establish an angle which has a fixed orientation on an earth coordinate reference frame despite the spinning of one or both portions of the projectile. Ground or sea-based radio and radar communications or an on-board roll reference system continuously communicates with the projectile, informing it of its own rotation rate and providing command signals for the nose deflection needed to establish the proper real-time trajectory correction. The weight, weight distribution, and configuration of the aerodynamic surfaces of each of the segments are coordinated such that the net lift vector substantially aligns with the center of mass to minimize in-flight torque forces at the joint.

18 Claims, 8 Drawing Sheets

FIG. 13 ZERO HINGE MOMENT CASE

FIGURE 10 (B)

DEFINITIONS $CP_1$= Center of pressure, front segment $CP_2$= Center of pressure, rear segment $m_1$= Mass of forebody $m_2$= Mass of aft body m= Mass of whole projectile

FIGURE 11 (B)

$q$ = dynamic pressure = $\frac{1}{2} pv^2$, where p = air density, v = velocity $s$ = area of base of projectile $C_N$ = Normal force coefficient $\alpha$ = angle of attack of forebody $\delta$ = bend angle, between fore & aft segments; ∴

$\alpha_1$ = angle of attack of fore segment $\alpha_2$ = angle of attack of aft segment $M_{H_1}$ = Hinge moment of front segment $M_{H_2}$ = Hinge moment of aft segment

FIGURE 12 *(A)*
EQUATION SHEET (eq5) $M_{H_b} = qS\left[C_{N_\alpha}\alpha + C_{N_\delta}(\alpha - \delta)\right]$ (eq6) $M_{H_t} = qS\left[m_1/m\ aC_{N_\delta}(\alpha - \delta) + (\Delta_1 - m_2/m\ a)C_{N_\alpha}\alpha\right]$

- THEN -

(eq7)

$$M_{H_t} = M_{H_b} = \frac{qSC_{N_\alpha}\ C_{N_\delta}\ \ (m_1/m\ b\Delta_1 - m_2/m\ a\Delta_2 + \Delta_1\Delta_2)\ \delta}{C_{N_\alpha}\left[\Delta_1 - m_2/m(a+b)\right] + C_{N_\delta}\left[\Delta_2 + m_1/m\ (a+b)\right]}$$

FIGURE 12 (B)

(eq8) $\Delta_2 = \Delta_1 = 0$ (eq9) $qSC_{N_\alpha}(\alpha - \delta) = m_2/m \; qS\left[C_{N_0}\alpha + C_{N_\alpha}(\alpha - \delta)\right]$ (eq10) $qSC_{N_0}\alpha = m_1/m \; qS\left[C_{N_0}\alpha + C_{N_\alpha}(\alpha - \delta)\right]$ (eq11) $$\frac{m}{m_2} = \frac{C_{N_0}\alpha}{C_{N_\alpha}\alpha\,(\alpha - \delta)} + 1 \; ; \; \frac{m}{m_1} = \frac{C_{N_\alpha}\alpha\,(\alpha - \delta)}{C_{N_0}\alpha} + 1$$

SEGMENTED PROJECTILE WITH DE-SPUN JOINT

BACKGROUND OF THE INVENTION

The invention is in the field of "smart" missiles and projectiles, and especially pertains to projectiles intended for use with airborne targets.

Projectiles in this area can be divided into two basic groups. First there are the self-propelled missiles which generally have on-board guidance systems and explosive charges. These are relatively complex arms items.

Second there are the artillery shells. Of the two, these are of course much simpler and generally less expensive. They are not self-propelled as a rule, although some designs incorporate trajectory correcting propulsive charges. Artillery shell projectiles are usually cheaper, simpler, and faster to deploy than missiles. They are the preferred form of terminal defence when defending, for example, a ship from in-bound missiles. Once one of these missiles is detected, there may be only a few seconds to destroy it, suggesting rapidly fireable artillery shells.

Additionally, because it is reasonable to assume that in many cases it will take several projectiles to destroy the incoming missile, it is desirable that they be inexpensive, simple, and quick to deploy and storable in reasonable quantities aboard the ship.

The challenge in producing an artillery projectile effective against incoming missiles lies in the need to make it "smart" so that it can correct its trajectory in real time. Because the incoming missile has its own evasive action program, no level of accuracy at the firing point will achieve contact. Incorporating trajectory-correcting capabilities in an artillery shell is complicated, compared to missiles, for two reasons. First, an artillery shell experiences thousands of G-forces when fired, so that any guidance mechanism must withstand this kind of shock. Second, whereas a missile is a relatively larger, more complex and more expensive device in which the incorporation of guidance systems may be done with relative ease, a shell is smaller, simpler, and cheaper, and does not traditionally have an on-board fuel supply to make propulsive corrections.

"Smart" artillery shells represent an area of some interest to the Pentagon at present. There have been a number of different schemes incorporated into the shells to effect trajectory correction. Most of these involve the detonation of propulsive charges on the sides of the projectiles responsive to information received from the mothership. Typical of this type of solution is U.S. Pat. No. 4,176,814 for a TERMINALLY CORRECTED PROJECTILE. U.S. Pat. Nos. 4,899,956 and 4,898,340 are also exemplary of this approach.

U.S. Pat. No. 4,399,962 on a WOBBLE NOSE CONTROL FOR PROJECTILES discloses a projectile with a nose which pivots at a hinge joint responsive to the firing of one of a multiplicity of charges at the joint area to deflect the nose, and thus deflect the missile toward its intended target. Intelligence is provided to the projectile from the mothership. There is no de-spinning, and the nose flips back and forth as the projectile rotates to maintain the appropriate net angle of attack of the nose.

Because most projectiles are spinning in flight for stability, it may be necessary in some designs to de-spin a portion of the projectile to provide a reference for trajectory correction. One approach to de-spinning is shown in U.S. Pat. No. 4,426,048.

In an article entitled "Atmospheric flight of a Variable-Bend body" in the *JOURNAL OF GUIDANCE AND CONTROL*, Volume 2, Number 5, September-October 1979, Page 382, the inventor and a co-author discuss the prospect of a bentbody projectile guidance technique dubbed "switchtail" technology. The theoretical aspects of switchtail techniques were investigated, but the article stopped short of describing how to actually produce a functional projectile using switchtail control force reduction theories.

SUMMARY OF THE INVENTION

The instant invention is a projectile comprised of two jointed segments connected by a universal joint or the like. When the projectile is fired, ordinarily both segments are rotating in the same direction. In the preferred embodiment the two segments are coupled so that they must rotate together.

Whereas the outsides of both segments are rotating together at an angular velocity on the order of 10 revolutions per second, one of the segments, which is the rear portion in the disclosed embodiment, has a de-spinning system which counter rotates an angle drive which establishes a bend or elbow between the two shell segments which is non-rotational in earth coordinates because it is reverse-rotated relative to the spinning rear shell portion. Thus, for example, the elbow joint may be bent in flight so that the shell tip is deflected toward the 2 o'clock orientation relative to its flight path, and maintain that deflection steadily even though both of the shell segments are rotating.

In-flight angulation of the projectile at the joint with forces low enough to be practical is made possible by carefully coordinating the weight, weight distribution, and aerodynamic surface configuration of each individual segment of the projectile so that the lift vector substantially aligns with and equates to the inertial load of the segment so that moments at the joint are minimized.

BRIEF DESCRIPTION OF THE DRAWINGS

FIG. 13 is a graph illustrating the mass ratios between the fore and aft segments of the projectile at certain selected terrametric values.

DETAILED DESCRIPTION OF THE PREFERRED EMBODIMENT

The spinning projectile is indicated at 10 and has a first segment 12 and a second segment 14. These segments are jointed together, and in the preferred embodiment the first segment is the rear portion of the shell, with the second segment being the front part. However, insofar as the invention describes the first segment as housing the angle control structure for the projectile, the first segment could also be the front portion of the shell, rather than the rear portion. In other words, the operative mechanism of the shell could be in either the front segment or the rear segment.

Each of the segments supports its own weight at its angle of attack, and the center of mass of each segment is substantially aligned with net lift vector of the respective segment as it moves along its intended course. Otherwise, large forces and resistance to movement would be experienced at the joint.

Figure 2:
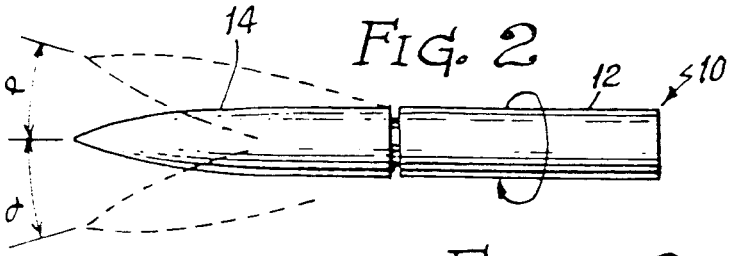
FIG. 2 illustrates the swiveling between the two segments.

The concept of the invention is to provide a deflection of the forward portion of the projectile off the projectile's longitudinal axis to achieve steering in the direction in which the nose is deflected. Although this task would be simplified somewhat if the shell traveled perfectly in-line and non-rotationally, this is not the case. The shell in fact rotates in flight as shown in FIG. 2 to provide roll orientational information. If a simple bend were put between the two segments in flight, the elbow would wobble around at the rotational speed of the projectile, which would ordinarily be on the order of 10–20 revolutions per second. Obviously this would achieve a trajectory correction in continuously changing directions, with a net change that would be meaningless. If the shell is to spin in flight, some mechanism is required to stabilize the joint so that it is fixed orientationally relative to earth coordinates.

Figure 7:
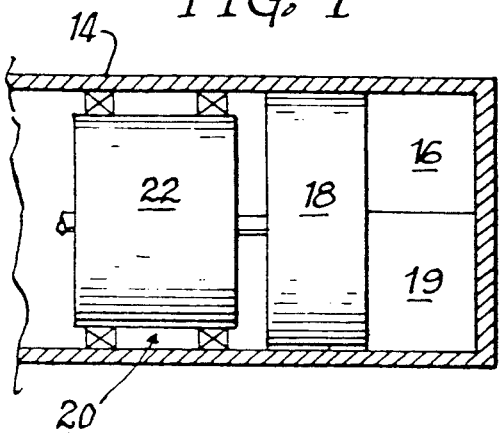
FIG. 7 is a section taken longitudinally of the projectile illustrating the structure in the rear projectile segment.

This fixing, or de-spinning of the joint is achieved in the following manner in the instant invention. As shown in FIG. 7, the rear segment 14 of the projectile fixedly mounts an electronic package 16 which includes a radio receiver and controller. After the projectile is fired, it is tracked by ship-based radar which tracks not only its trajectory but its rate of rotation, which it can do by virtue of corner reflectors placed on the base of the projectile. None of this structure is shown in the instant disclosure, as it is currently in use for similar purposes and thus does not represent innovative subject matter of this disclosure. The radar information is processed on-board ship and is transmitted to the projectile with information on the direction and the amount of the desired deflection of the nose to achieve proper trajectory correction.

The rotation drive means 18 is fixed relative to the projectile—that is, it does not rotate relative to the front segment of the projectile body. It is controlled by the controller in the electronics package 16 and powered by battery pack 19. This motor drives a forward joint module 20, which is rotational relative to the projectile. Generally speaking, the motor drives the joint module in a direction equal and opposite to the rotation of the first segment 12 of the projectile.

For example, if the projectile exits the gun at an initial rotation rate of 20 cycles per second clockwise in the direction facing the target, the motor 18 drives the joint module 20 in the counter-clockwise direction at 20 revolutions per second, so that the joint module is non-rotational relative to earth coordinates.

Figure 3:
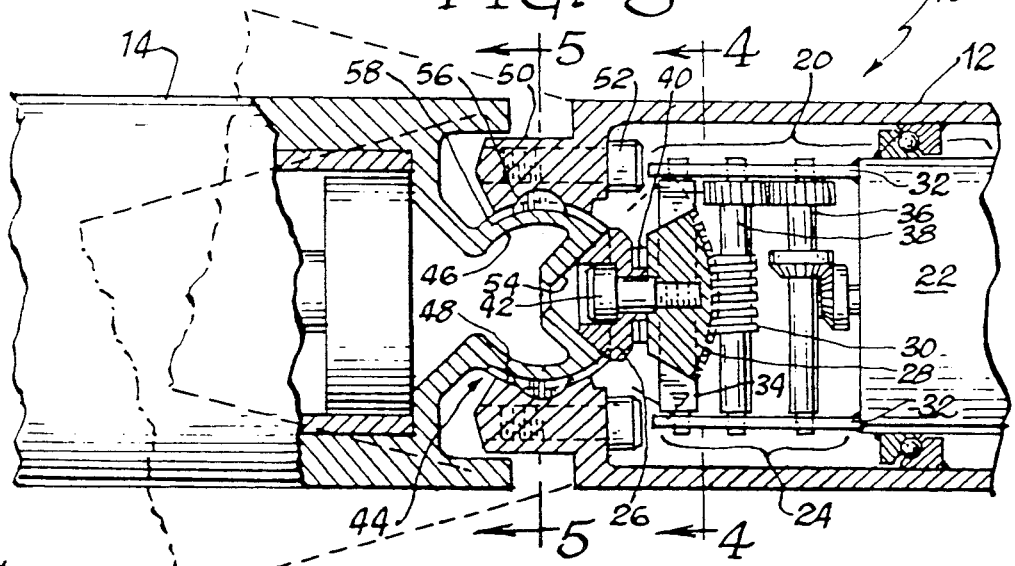
FIG. 3 is a section view taken longitudinally of the projectile illustrating the angle adjustment system.

One possible joint module is shown in FIG. 3. It comprises a motor 22, gear linkage 24 and a conical spindle 26 which mounts an arcuate rack 28 driven by the worm gear 30 of the gear linkage.

Figure 5:
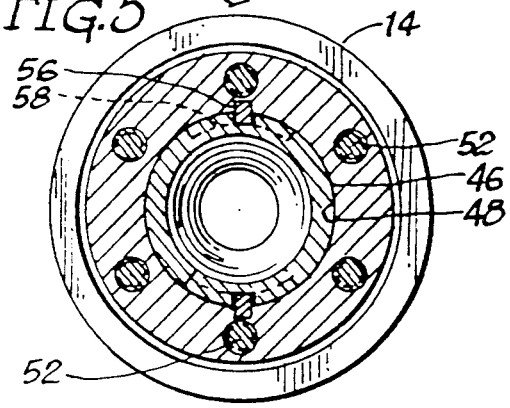
FIG. 5 is a section taken along line 5—5 of FIG. 3.

As seen from the plane of FIG. 5, the joint module structure is held together by a pair of spanning centering bars 34 passing along the opposite sides of the rack 28. The two shafts 36 and 38 are journaled in the side plates 32. The conical spindle 26 either defines a sliding bearing surface at its conical surface, or rotates on bearings 40 (or both). In any event, relative rotation must be established between the joint module 20 and the structure forward of the joint module which is attached to the first segment 12 of the projectile.

The conical spindle 26 is attached by means of a bolt 42 to the rack 28. The bolt 42 is always aligned with the axis of the front or second segment 14 of the projectile. However, by operation of the motor 22, shafts 36 and 38 are rotated through their respective gears, rotating the worm gear 30 to deflect the rack 28 and its bolt 42 and the conical spindle 26 a few degrees in the plane of the rack gear.

Since the joint module is non-rotational in earth coordinates, the angle established by the bolt 42 as it is deflected relative to the axis of the first segment 12 of the projectile is fixed to achieve the appropriate deflection as commanded by the controller at 16. Because the joint module is non-rotational, the desired angle is stable and will effectively maintain the correction to the course of the projectile without wobble.

Figure 4:
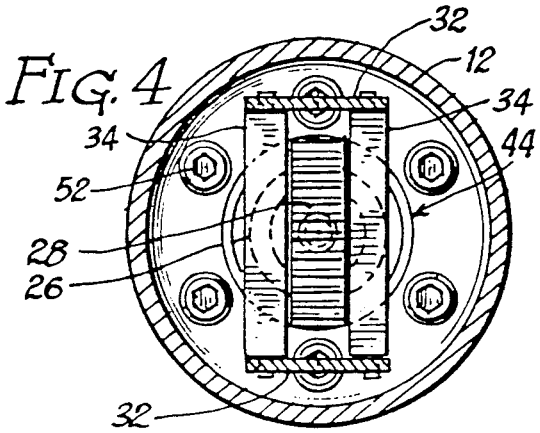
FIG. 4 is a section taken along line 4—4 of FIG. 3.

Turning to the first example given in which the missile is rotating 20 cycles per second clockwise, the joint module would be rotating at 20 Hz in the counter clockwise direction. Thus, the joint is non-rotational. However, the joint may not be set to move in the correct plane. In the orientation shown in FIG. 4, the tip can be deflected vertically up or down by operating the motor 22 in the appropriate direction. However, should it be desired to deflect the missile in the 2 o'clock direction, the orientation of FIG. 4 would be changed by slowing the rotation of the joint module 20 so that it looses speed relative to the outer shell, and quickly drifts clockwise into the 2 o'clock position, at which point the joint module would be sped up again to exactly match the speed of the rotating outer shell. Alternatively, speeding the joint module rotation would move the joint rotationally in the counter clockwise direction. Thus, it is relatively simple to establish and maintain any angle of orientation of the projectile joint.

The disclosure thus far has centered around the rotation of the rear portion of the projectile, with the joint module angularly rotating this forward portion of the projectile in the opposite direction. Turning to the front, or second segment 14 of the projectile, in the preferred embodiment it is attached to the rear segment by means of a ball-and-socket joint 44. The front segment defines a ball element 46, and the rear segment defines a socket element 48. The forwardmost portion of the socket 48 comprises a bolted-on retainer ring 50 whose bolts 52 securely grasp the spherical ball element 46.

It would be entirely possible to have the front segment 14 of the projectile non-rotational relative to the joint module 20, so that only the rear part of the projectile would spin. If this were the case, the conical spindle 26 could be integral with the ball element 46, rather than sliding in the conical cavity 54 and would obviously require de-coupling sections 12 and 14. However, in the illustrated embodiment the front portion of the projectile rotates with the rear segment 12. With the ball-and-socket connection as described above, the front portion of the projectile could free-wheel or roll independently of the rear portion. Coming out of the barrel of the firing gun, they would ordinarily be expected to have similar rates of rotation, although aerodynamic surfaces or reaction control on one portion or the other would effect this.

Figure 1:
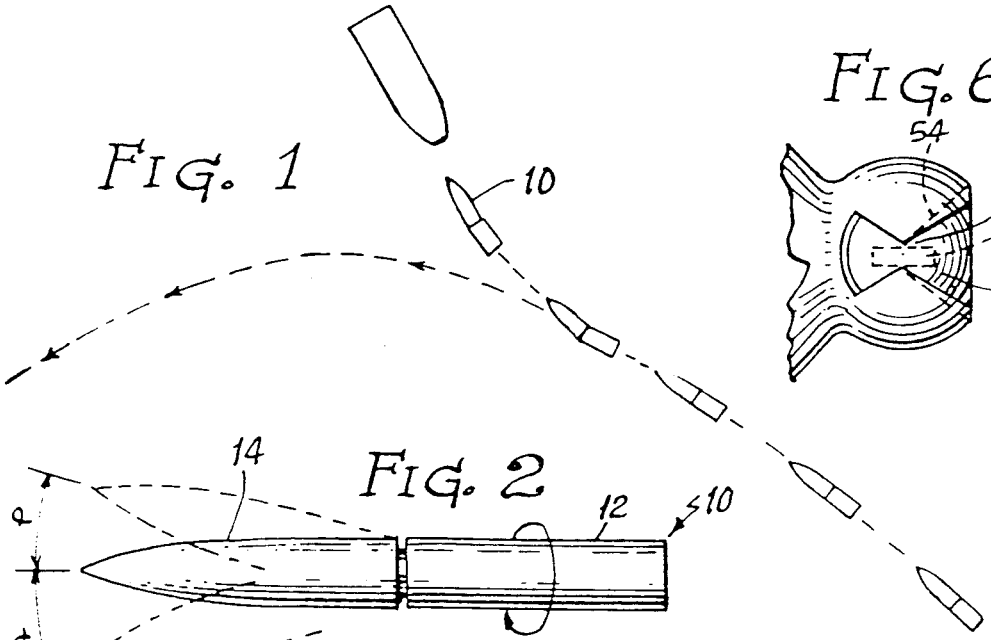
FIG. 1 illustrates diagrammatically the operation of the projectile against an incoming missile.
Figure 6:
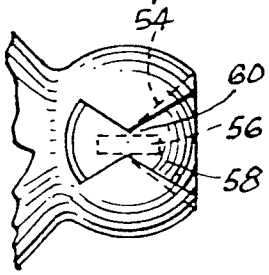
FIG. 6 is a detail illustrating the spline in the hourglass-shaped groove configuration of the ball and socket joint.

However, in the illustrated embodiment the two segments are forced to rotate together by means of slotted pins or splines 56 which seat in mating groves 58 in the ball. These splines and grooves are preferably two in number and are defined on opposite sides of the ball-and-socket joint. This spline and groove configuration positively prevents relative rotation between the two projectile segments. Although the splines 56 are conventional straight splines, the grooves 58 are hourglass-shaped as shown in FIG. 6 to accommodate the angular movement that the ball-and-socket must undergo relative to one another while blocking relative rotation. The hour glass grooves each has an apex bearing channel 60 which is spanned at all times by the spline 56.

Figure 8:
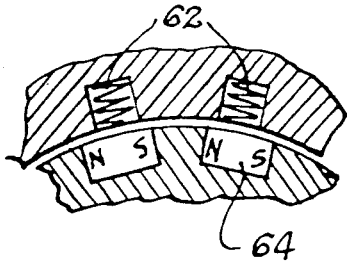
FIG. 8 is a diagrammatic illustration of an electrically driven ball mechanism.

Although the gear mechanical drive is a simple and very durable system, other systems could be used such as a hydraulic drive or an electric drive. An electric drive is very diagrammatically seen in FIG. 8 wherein either the ball or the socket has mounted therein coils 62 which interact with the fixed magnets 64 to angularly counter-rotate the ball relative to the socket.

Figure 9:
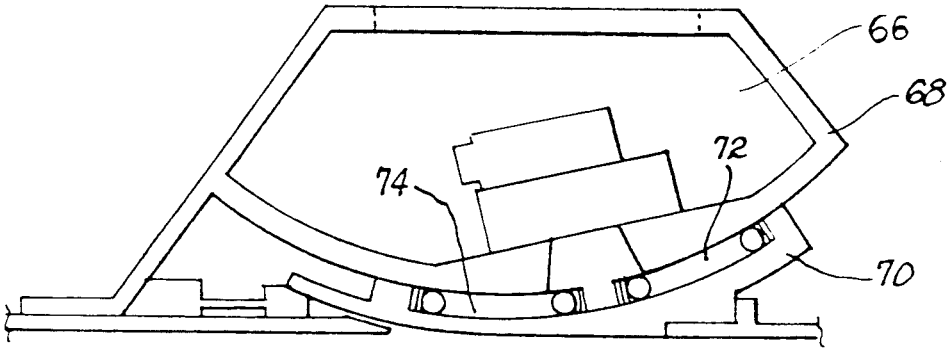
FIG. 9 is a somewhat diagrammatic illustration of a Thiovec bearing illustrating incorporation of a hydraulic drive in the shell.
Figure 9:
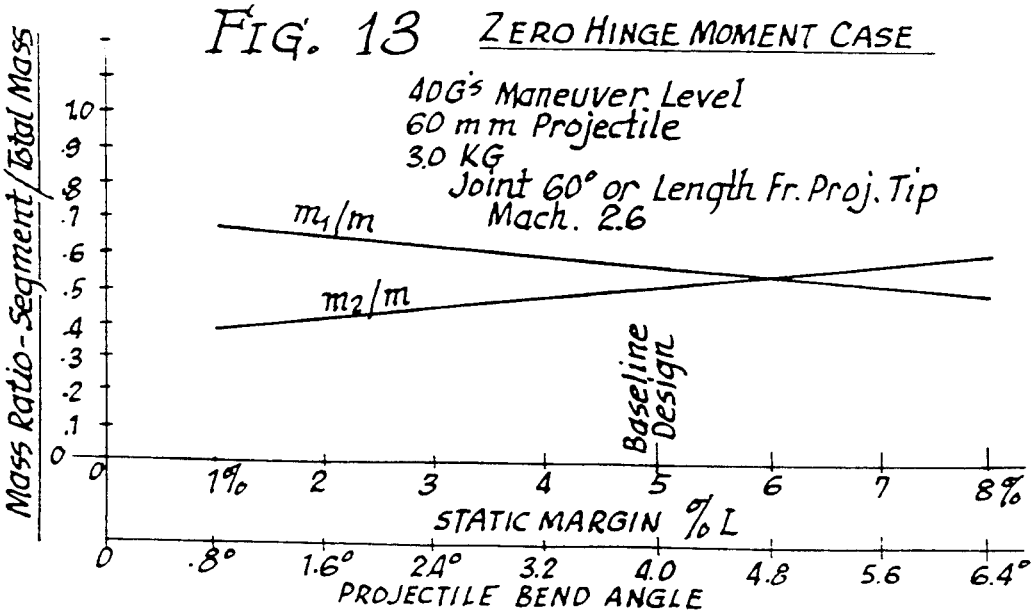

A hydraulic system is shown in FIG. 9 which represents a Thiovec hydraulically operated bearing. This bearing is standard and will not be described beyond identifying the fluid reservoir 66, the inner race 68, the outer race 70, and forward and aft actuators 72 and 74. Clearly this example has not been incorporated into the physical structure of the rest of the shell, but it is equally clear from its operation that it could be incorporated with the application of ordinary engineering skill.

Reviewing the overall operation of the spinning projectile, as it is first fired from the missile, both segments 12 and 14 will rotate concomitantly by dint of the spline connection just described. Shortly into its trajectory, ship-based radar, which is tracking both the projectile and the incoming missile, provides data to the ship computer which calculates the projectile spin rate, roll orientation and then instantaneously calculated the desired course change and radios it back to the projectile. At this time, the counter-rotation motor 18 establishes the desired angular counter-rotation of the joint module 20. An instruction received by the rotation motor 18 then slows or increases its speed slightly for a few milliseconds to establish the right plane of movement of the hinge joint established by the joint module, and the joint-angle establishing motor 22 drives the spindle 26 to the appropriate angle and stops. Instantaneously, the trajectory changes, and as the trajectory change is recalculated by the on-board computer, continuing course changes are made until there is (hopefully) impact with the incoming missile.

Although theoretically the projectile could be made to work irrespective of considerations of balancing the two segments to minimize friction-creating and torque moment forces at the joint, as a practical matter due to the limited space available to house the joint angulating motive force, it is desirable, if not absolutely necessary to properly balance each segment. This concept is illustrated in FIG. 13. Each of the segments has its own in-flight net lift vector illustrated as $F_L$. The lift vector extends from the center of lift, and the center of lift and the direction of the lift vector are affected by both the speed of the projectile and the aerodynamic configuration of the surface. The inertial force, indicated as $F_I$ originates at the center of gravity at the segment and its direction is dictated by weight distribution in the segment and acceleration forces that it experiences.

Figure 10:
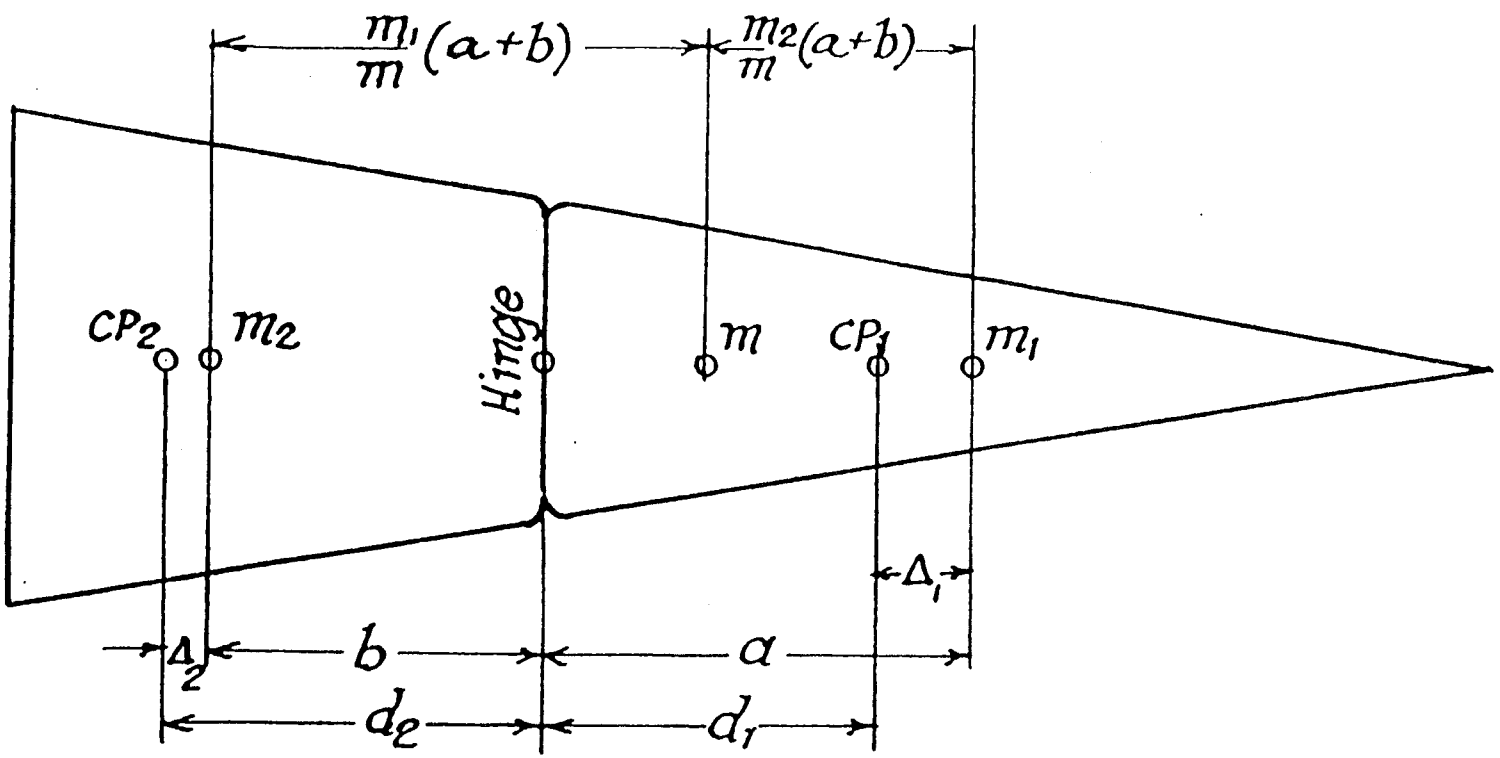
FIGS. 10*a* and 10*b* are diagrammatic views of a projectile defining certain parameters.
Figure 11:
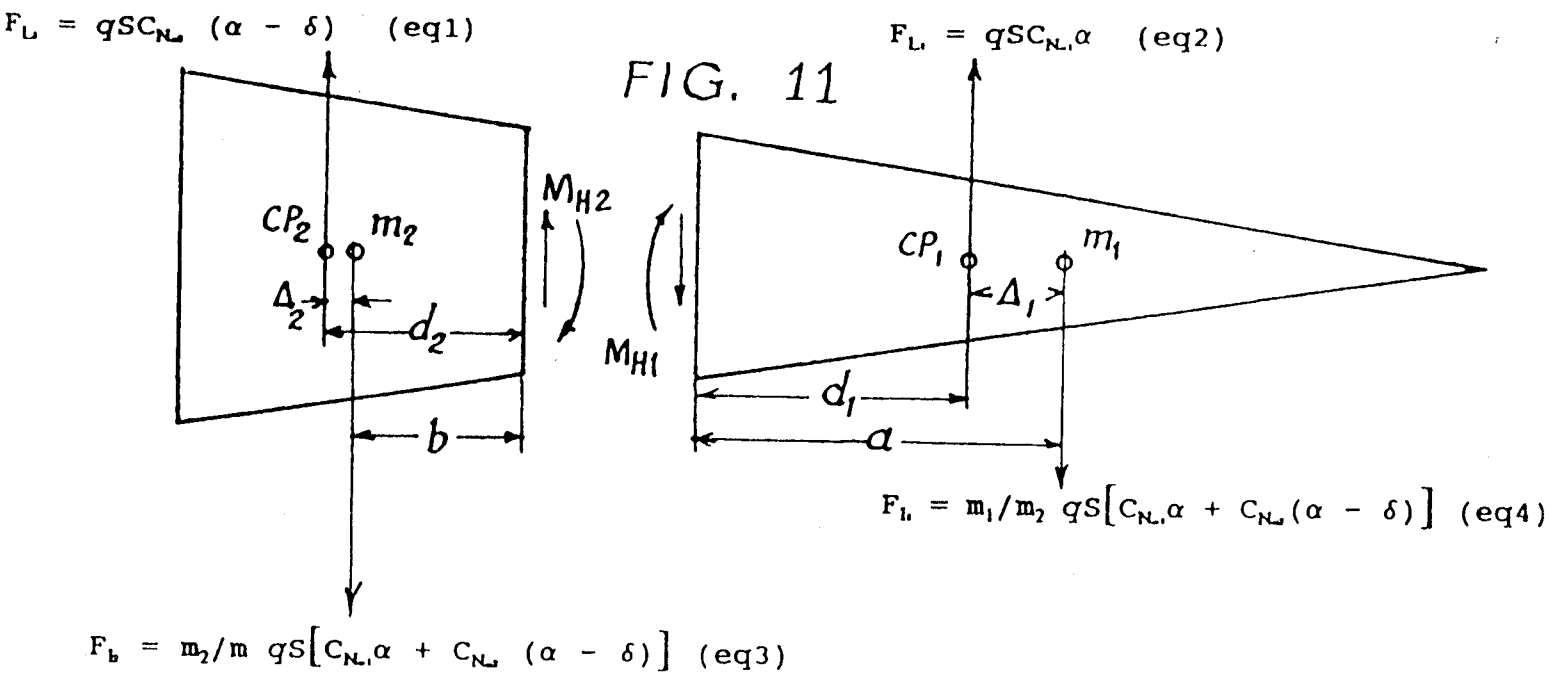
FIGS. 11*a* and 11*b* are diagrammatic views of the projectile defining other parameters; and, FIGS. 12*a* and 12*b* are list of the equations used to calculate the zero hinge moment configurations displayed on the graph of FIG. 13.

As mentioned, in order for the switchtail scheme to work, the projectile must be designed to minimize torque around the hingepoint, or hinge moments. Doing this involves going through moderately complicated computations as follows. FIGS. 10 and 11 outline a diagrammatic illustration of a model format of the projectile and identify certain variables that are used in the equations necessary to zero out hinge moments at the projectile joint. Without zeroing out the hinge moment, the enormous forces experienced by the projectile when making turns at several times the speed of sound would cause forces at the joint that would be so overwhelming that it would be impractical to install a mechanism with adequate strength to overcome the hinge moments.

Turning to FIG. 11, the forces on each segment of the projectile are summarized in the equations that are written adjacent the respective force vectors. Each individual segment of the projectile will have two basic force vectors, in the simplified model shown, which must be neutralized. The $B_1$ vector is the lift vector in the direction normal to the longitudinal axis of the projectile, and the $B_I$ vector is the inertial load vector in the direction normal to the projectile segment axis. "1" subscript identifies the front or fore projectile segment, and the "2" subscript identifies the rear or aft segment or aft body.

The equations written adjacent each of the force vectors quantifies the force in the normal direction on the respective segment. These equations represent equations 1 through 4.

The hinge moments of the aft and fore segments about the joint are quantified in equation form in Equations 5 and 6. These expressions are derived from the net lift vector and the net inertial load vector expressions from FIG. 11. It is these hinge moments that must be zero for optimum performance of the projectile.

In order to design a projectile with zero hinge moments, the expressions of Equations 8 through Equation 11 must be satisfied. Equation 1 requires that the center of pressure lie on the center of mass, see FIG. 11. Equation 9 equates the lift force with the inertial load force for the rear of aft body or segment, and Equation 10 does the same thing for the fore body. Solving equations 8 through 11 simultaneously with replacement of certain variable, the details of which will not be presented, results in Equation 7. Equation 7, then, sets forth the condition of zero hinge moment. Both MH1, which is necessarily the same as MH2, as each one is zero, is equal to the expression on the right side of the equation of FIG. 7.

In order to solve this, certain parameters of the projectile configuration must be selected. The graph of FIG. 13 represents solutions to Equation 7 when the left half is zero, that is, when the hinge moments are zero. It is solved for the ration between the respective fore- and aft- body masses relative to the overall projectile mass. The fixed parameters are an inertial load of 40 G forces, a 60 mm projectile with an overall projectile weight of 3 kilograms, a joint between the two segments lying at a point 60% of the distance from the front tip of the projectile to the rear, and the velocity of the projectile being Mach 2.6.

An inspection of FIG. 13 reveals the selection of the distribution of the mass between the front and rear segments of the projectile which must be used to zero out hinge moments for various static margins. The static margins where the overall projectile is the distance between the center of mass and the center of lift of the overall projectile, divided by the projectile length. The "base line design" at a 5% static margin, represents the position on the graph identifying the parameters used by applicant in the principal theoretical test model. Utilizing this weight distribution, the hinge moments will be minimized over the speed range from Mach 2.0 to 4.0. For a steady state 40 G maneuver, at Mach 3.5, a hinge moment has been measured at 0.5 ft-lb, with the worst case existing at −0.66 ft-lb at Mach 2.0. Therefore, with this configuration, very little power is needed to establish different bend angles even for major maneuvers. This successfully minimizes the space required for the joint angulation powering mechanism, leaving more space for control systems, electronics and payload, and in the last bottom line analysis, actually making the technology feasible.

The instant disclosure illustrates one way of achieving the goal of establishing a fixed, non-rotational bend angle in a two-segmented projectile while one or both of the segments individually rotates. Clearly, there are other ways of achieving this. The heart of the invention, therefore lies in the de-spinning of the joint while the body of one or both halves of the projectile spins, and then establishing the bend angle fixed in earth coordinates, and secondarily in the ball-and-socket joint connection which rotationally couples the two segments while permitting the angle of the hinge joint to be set.

The invention represents a very rugged and simple solution to the problem of trajectory change in-flight, and does not rely on the incorporation of explosive charges or fuel to change trajectory. Course changes can be made in milliseconds, adequate to accommodate the needs of a projectile heading out at nearly a mile per second, which is required to encounter a missile incoming at about the same speed.

It is hereby claimed:

1. A projectile for use in conjunction with an information system which delivers projectile spin rate information and deflection commands to the projectile, said projectile comprising:

(a) a first segment defining a first longitudinal axis and a substantially longitudinally aligned second segment jointed thereto with a variable angle hinge joint;

(b) said first segment mounting a joint module which includes said hinge joint and also includes angle drive means to vary the angle of said hinge joint;

(c) said joint module being rotational inside said first segment, and including rotational drive means for rotating said module about the longitudinal axis of said first segment; and (d) control means mounted within said projectile and being operative with said information system to command said angle drive means to vary the angle of said hinge joint and to control said rotational drive means to rotate said module at a speed substantially equal and opposite to the rate of any rotation of said first segment to cause same to establish an orientation for said hinge joint which is substantially fixed in terms of earth coordinates.

2. Structure according to claim 1 wherein said projectile has a forward travel direction and each of said segments is configured such that it will support its own weight in flight and that its center of mass is substantially aligned, with its center of aerodynamic lift when traveling substantially in said forward travel direction.

3. Structure according to claim 1 wherein said drive means is a motor having a drive shaft substantially aligned with said first segment longitudinal axis and connected to said joint module.

4. Structure according to claim 1 wherein said second segment defines a second longitudinal axis and said hinge joint provides said second segment freedom of movement to rotate about said second longitudinal axis.

5. Structure according to claim 4 wherein said hinge joint comprises a ball joint having a ball element and a socket element, with one of said elements being fixed to said first segment and the other of said elements fixed to said second segment.

6. Structure according to claim 5 wherein the other of said elements mounts, rotationally about the second longitudinal axis, an axis-establishing spindle for establishing the angle of the second longitudinal axis relative to said first longitudinal axis.

7. Structure according to claim 6 wherein said one of said elements fixed to said first segment comprises said socket, and the other of said elements fixed to said second segment comprises said ball, and said ball defines an axially symmetric bearing cavity rotationally seating said spindle.

8. Structure according to claim 7 wherein said cavity is conical, and said spindle defines a cone seated in said cavity.

9. Structure according to claim 8 wherein said spindle mounts a rack gear and said angle drive means comprises an angle drive motor and gear linkage driving said rack gear by said angle drive motor.

10. Structure according to claim 5 and including means compelling concomitant rotation of said first and second segments.

11. Structure according to claim 10 wherein said means compelling concomitant rotation comprises a spline and groove structure incorporated into said ball joint.

12. Structure according to claim 11 wherein said groove is defined in said ball element and is configured as a recess which is hour glass-shaped in planform aligned parallel with said first longitudinal axis and defining a central bearing apex.

13. Structure according to claim 12 wherein said spline extends from said socket, is longitudinally aligned, and rides in the bearing apex of said groove.

14. Structure according to claim 13 wherein said spline and grooves are duplicated and radially spaced around the longitudinal axis of said ball joint.

15. Structure according to claim 1 wherein said first segment comprises the rear portion of said projectile, and the second segment comprises the forward portion of said projectile.

16. Structure according to claim 1 wherein said angle drive means is electric.

17. Structure according to claim 1 wherein said angle drive means is hydraulic.

18. Structure according to claim 17 wherein said angle drive means is by a Thiovec bearing.

* * * * *